US012342980B2

(12) United States Patent
Kim et al.

(10) Patent No.: US 12,342,980 B2
(45) Date of Patent: Jul. 1, 2025

(54) CLEANER SYSTEM

(71) Applicant: LG Electronics Inc., Seoul (KR)

(72) Inventors: Sungjun Kim, Seoul (KR); Jungwan Ryu, Seoul (KR); Daeho Chang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/034,607

(22) PCT Filed: Oct. 29, 2021

(86) PCT No.: PCT/KR2021/015428
§ 371 (c)(1),
(2) Date: Apr. 28, 2023

(87) PCT Pub. No.: WO2022/092890
PCT Pub. Date: May 5, 2022

(65) Prior Publication Data

US 2023/0404344 A1 Dec. 21, 2023

(30) Foreign Application Priority Data

Oct. 29, 2020 (KR) ..... 10-2020-0142060

(51) Int. Cl.
*A47L 9/14* (2006.01)
*A47L 5/22* (2006.01)
(Continued)

(52) U.S. Cl.
CPC ..... *A47L 9/149* (2013.01); *A47L 5/22* (2013.01); *A47L 9/0063* (2013.01);
(Continued)

(58) Field of Classification Search
CPC ..... A47L 2201/024; A47L 9/149; A47L 5/22; A47L 9/0063; A47L 9/1633;
(Continued)

(56) References Cited

U.S. PATENT DOCUMENTS

2007/0226949 A1* 10/2007 Hahm ..... A47L 9/009 15/340.1
2008/0201895 A1 8/2008 Kim et al.
(Continued)

FOREIGN PATENT DOCUMENTS

DE 10-2017-126393 A1 5/2019
KR 10-2006-0008364 1/2006
(Continued)

OTHER PUBLICATIONS

Extended European Search Report in European Appln. No. 21886884.2, mailed on Sep. 4, 2024, 5 pages.

*Primary Examiner* — Bryan R Muller
(74) *Attorney, Agent, or Firm* — Fish & Richardson P.C.

(57) ABSTRACT

A cleaner system includes: a cleaner which includes a dust bin having one openable side thereof; and a cleaner station on which the cleaner is mounted. The cleaner includes: a first discharge cover which covers a portion of the open side of the dust bin; and a second discharge cover which covers the rest portion of the open side of the dust bin. The cleaner station includes a dust collection motor which generates a suction force sucking dust within the dust bin. Therefore, the suction force of the dust collection motor is concentrated by opening the second discharge cover first, so that adsorbed small dust is more easily sucked. Large dust is sucked by opening the first discharge cover after the small dust is sufficiently sucked, so that dust is efficiently discharged under the general power of the dust collection motor.

19 Claims, 7 Drawing Sheets

(51) Int. Cl.
*A47L 9/00* (2006.01)
*A47L 9/16* (2006.01)
*A47L 9/28* (2006.01)

(52) U.S. Cl.
CPC ..... *A47L 9/1633* (2013.01); *A47L 9/1683* (2013.01); *A47L 9/2842* (2013.01); *A47L 9/2873* (2013.01)

(58) Field of Classification Search
CPC .... A47L 9/1683; A47L 9/2842; A47L 9/2873; A47L 5/24; A47L 9/106; A47L 9/1409; A47L 5/26; A47L 9/102; A47L 9/2836; A47L 7/0095
See application file for complete search history.

(56) References Cited

U.S. PATENT DOCUMENTS

| | | | | |
|---|---|---|---|---|
| 2011/0056045 | A1* | 3/2011 | Sepke | A47L 9/1666 15/347 |
| 2016/0106284 | A1 | 4/2016 | Mantyla et al. | |
| 2022/0160201 | A1* | 5/2022 | Cho | A47L 9/106 |

FOREIGN PATENT DOCUMENTS

| | | |
|---|---|---|
| KR | 10-2006-0018009 | 2/2006 |
| KR | 10-2006-0024592 | 3/2006 |
| KR | 10-1985314 | 9/2019 |
| KR | 10-2020-0074054 | 6/2020 |

* cited by examiner

CLEANER SYSTEM

CROSS-REFERENCE TO RELATED APPLICATIONS

This application is a National Stage application under 35 U.S.C. § 371 of International Application No. PCT/KR2021/015428, filed on Oct. 29, 2021, which claims the benefit of Korean Patent Application No. 10-2020-0142060, filed on Oct. 29, 2020. The disclosures of the prior applications are incorporated by reference in their entirety.

TECHNICAL FIELD

The present disclosure relates to a cleaner system and more particularly to a cleaner and a cleaner system including a cleaner station that mounts the cleaner and cleans dust present in a dustbin of the cleaner.

BACKGROUND ART

In general, a cleaner is a home appliance which sucks small garbage or dust in a way of sucking air by using electricity and fills the garbage or dust in a dust bin included in the cleaner product. The cleaner is usually called a vacuum cleaner.

Such a cleaner can be divided into a manual cleaner which performs cleaning by being moved directly by a user and an automatic cleaner which performs cleaning while travels by itself. The manual cleaner can be divided into a canister vacuum cleaner, an upright vacuum cleaner, a hand vacuum cleaner, and a stick vacuum cleaner, etc., in accordance with the shape thereof.

In the past, the canister vacuum cleaner has been used widely as a household cleaner. However, recently, the hand vacuum cleaner and the stick vacuum cleaner, which include a dust bin formed integrally with the body of the cleaner and provides improved convenience for use, tend to be used a lot.

In the case of the canister vacuum cleaner, the body and the suction port thereof are connected by a rubber hose or pipe. In some cases, the cleaner can be used in such a way that a brush is inserted into the suction port.

The hand vacuum cleaner has the maximized portability, and thus, has a light weight and a short length. Therefore, the cleaning area of the cleaner may be limited. Accordingly, the hand vacuum cleaner is used to clean a local place such as on a desk or sofa, the inside of a vehicle.

The stick vacuum cleaner allows a user to use itself with a standing posture, and thus, the cleaning can be made without bending his/her waist forward. Accordingly, it is advantageous for cleaning while moving over a wide area. While the handy vacuum cleaner cleans a narrow space, the stick vacuum cleaner is able to clean a wider space than the narrow space and to clean a high place out of reach. Recently, the stick vacuum cleaner is provided in the form of a module, so that the type of the cleaner is actively changed according to various objects.

However, in the conventional hand vacuum cleaner and the conventional stick vacuum cleaner, since the dust bin that stores the collected dust has a small capacity, it is inconvenient for the user to empty the dust bin every time.

Also, dust scatters to adversely affect the user's health during the emptying of the dust bin.

Also, residual dust that has not been removed in the dust bin causes decrease in suction force.

Also, when the residual dust in the dust bin is not removed, odors occur due to the residue.

As a prior art, Korean Patent Application No. 10-2020-0074054 is proposed. The prior art relates to a cleaning device including a vacuum cleaner and a docking station.

According to the prior art, the vacuum cleaner includes a dust collector that collects foreign substances. The docking station is connected to the dust collector to remove foreign substances collected in the dust collector, and the dust collector is provided to collect the foreign substances through centrifugal separation. The docking station includes a suction device for sucking the foreign substances and indoor air within the docked dust collector.

The docking station according to the prior art is controlled by a controller. When the dust collector is docked, a cover disposed on the bottom surface of the dust collector is opened, and a suction motor is operated to suck dust within the dust collector by subatmospheric pressure.

However, there are various sizes of dust particles, and particularly small dust is called adsorbed dust and adheres to a wall surface by electrostatic force and does not come off easily. Therefore, in the case of the docking station in the prior art, apart from whether large dust can be easily sucked in, there is a problem that small dust is adsorbed within the dust bin and does not come off easily.

In this case, theoretically, small dust can be sucked by increasing the power of a suction motor. However, small dust is further influenced by an electrostatic force, so that the increase in the suction amount of small dust is insignificant compared to the power increase of the suction motor, and power consumption only increases.

DISCLOSURE

Technical Problem

The present invention is proposed to solve the above problems. The purpose of the present invention is to provide a cleaner system capable of more effectively sucking not only large dust but also small dust adsorbed within the dust bin among the dust collected within the dust bin in response to the problem of the prior art that the adsorbed small dust is not well sucked.

The purpose of the present invention is to provide a cleaner system that applies a suction force generated by lower electric power to large dust that is easier to suck among the dust collected within the dust bin and applies a suction force generated by higher electric power to small dust that is more difficult to suck.

The purpose of the present invention is to provide a cleaner station capable of preventing scattering of dust when the dust bin is emptied and a method for controlling the cleaner station.

The purpose of the present invention is to provide a cleaner station capable of providing convenience for users by allowing users to remove the dust in the dust bin even without a separate operation of the user, and a method for controlling the cleaner station.

Technical Solution

One embodiment is a cleaner system including a cleaner which includes a dust bin having one openable side thereof; and a cleaner station on which the cleaner is mounted. The cleaner includes: a first discharge cover which covers a portion of the open side of the dust bin; and a second discharge cover which covers the rest portion of the open side of the dust bin. The cleaner station includes a dust collection motor which generates a suction force sucking dust within the dust bin.

An inner space of the dust bin may be divided into a first dust separator and a second dust separator. The first dust separator communicates with a suction portion into which air flows. The second dust separator communicates with the first dust separator and is disposed downstream of the first dust separator. The first discharge cover may cover an area that communicates with the first dust separator in the open side of the dust bin. The second discharge cover may cover an area that communicates with the second dust separator in the open side of the dust bin.

A through-hole may be formed in one side of the first discharge cover. The second discharge cover may be disposed in the through-hole of the first discharge cover.

The first discharge cover may include a first hinge which is disposed on a top of the first discharge cover when the cleaner is mounted on the cleaner station.

The second discharge cover may be opened in an opposite direction to a dust bin body.

The second discharge cover may include a second hinge which is disposed on a top of the second discharge cover when the cleaner is mounted on the cleaner station.

At least a portion of the second discharge cover may be made of an elastic material.

The dust collection motor may be disposed below the dust bin when the cleaner is mounted on the cleaner station.

The discharge cover may be disposed perpendicular to the ground when the cleaner is mounted on the cleaner station.

Another embodiment is a method for controlling the cleaner system including: a cleaner including: a dust bin having one openable side thereof, a first discharge cover which covers a portion of the open side of the dust bin, and a second discharge cover which covers the rest portion of the open side of the dust bin; and a cleaner station on which the cleaner is mounted. The method includes: operating a dust collection motor disposed within the cleaner station "with a first power or higher", when the cleaner is mounted on the cleaner station; and opening the first discharge cover after a predetermined time elapses.

Advantageous Effect

According to the cleaner system of the present disclosure, one or more of the following effects are provided.

First, since the second discharge cover that covers only a portion of an open side of the dust bin is first opened before the entire discharge cover is opened, the subatmospheric pressure is further increased by concentrating the suction force of the dust collection motor on the inside of the second dust separator. Accordingly, the adsorbed small dust collected in the second dust separator can be more easily sucked.

Second, the first discharge cover is formed to surround the second discharge cover. Therefore, the dust is discharged stepwise such that the second discharge cover is first opened to discharge the small dust of the second dust separator, and then the first discharge cover is opened to discharge the large dust of the first dust separator.

Third, since the first elastic member applies an elastic force to the first discharge cover in the direction of opening the first discharge cover, the first discharge cover is not closed or not vibrated even when the dust collection motor operates.

Fourth, the controller operates the dust collection motor and operates the coupling lever, so that the second discharge cover is opened and small dust of the second dust separator is sucked, and the first discharge cover is opened and large dust of the first dust separator is sucked. As a result, dust is prevented from scattering and users do not have to clean the inside of the dust bin by themselves, thereby providing convenience to the user.

Advantageous effects of the present disclosure are not limited to the above-described effects and other unmentioned effects can be clearly understood from the description of the claims by those skilled in the art to which the present disclosure belongs.

MODE FOR INVENTION

Figure 1:
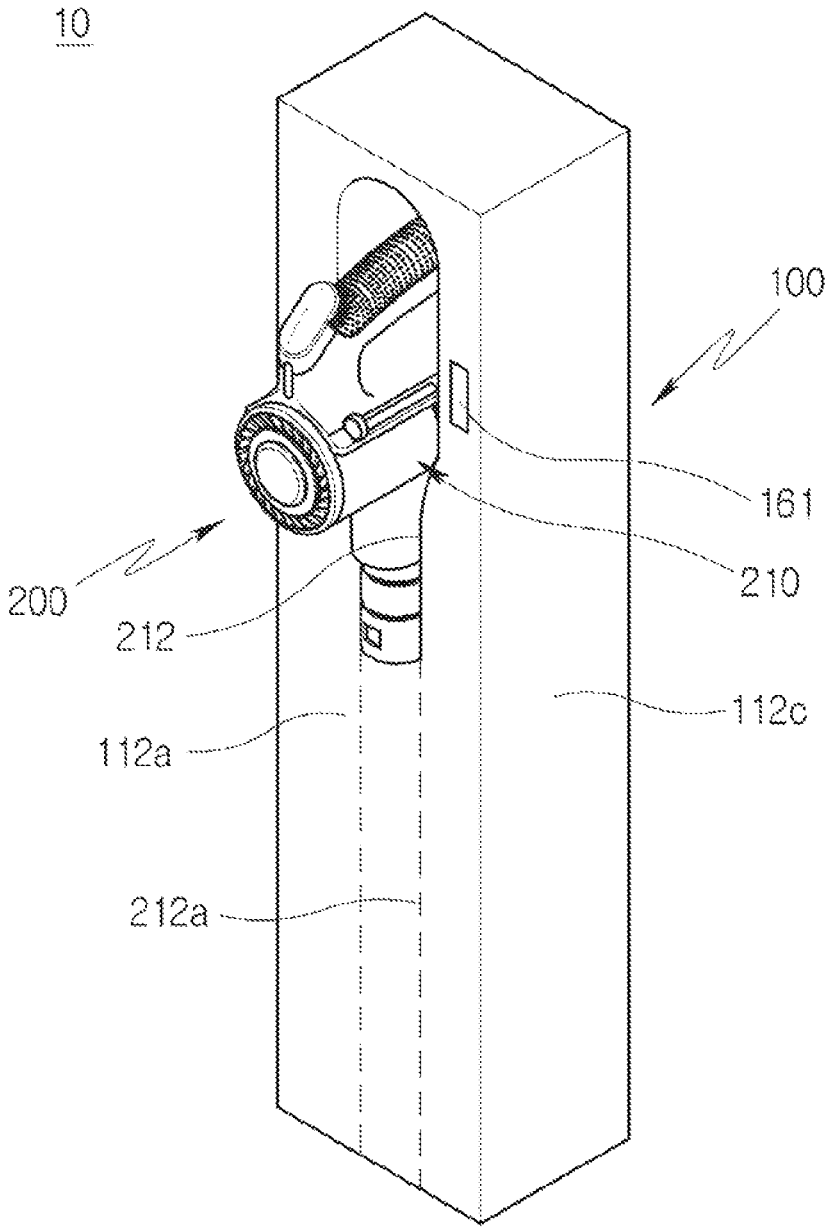
FIG. 1 is a perspective view of a cleaner system including a cleaner station and a cleaner.

Hereinafter, preferred embodiments of the present disclosure will be described in detail with reference to the accompanying drawings.

As the present disclosure can have various embodiments as well as can be diversely changed, specific embodiments will be illustrated in the drawings and described in detail. While the present disclosure is not limited to particular embodiments, all modification, equivalents and substitutes included in the spirit and scope of the present disclosure are understood to be included therein.

In the description of the present disclosure, while terms such as the first and the second, etc., can be used to describe various components, the components may not be limited by the terms mentioned above. The terms are used only for distinguishing between one component and other components. For example, the first component may be designated as the second component without departing from the scope of rights of the invention. Similarly, the second component may be designated as the first component.

The term of "and/or" includes a combination or one of a plurality of related items mentioned.

In the case where a component is referred to as being "connected" or "accessed" to another component, it should be understood that not only the component is directly connected or accessed to the other component, but also there may exist another component between them. Meanwhile, in the case where a component is referred to as being "directly connected" or "directly accessed" to another component, it should be understood that there is no component therebetween.

Terms used in the present specification are provided for description of only specific embodiments of the present disclosure, and not intended to be limiting. An expression of a singular form includes the expression of plural form thereof unless otherwise explicitly mentioned in the context.

In the present specification, it should be understood that the term "include" or "comprise" and the like is intended to specify characteristics, numbers, steps, operations, components, parts or any combination thereof which are mentioned in the specification, and intended not to previously exclude the possibility of existence or addition of at least one another characteristics.

Unless otherwise defined, all terms used herein including technical and scientific terms have the same meaning as commonly understood by one of ordinary skill in the art to which the present disclosure belongs. Terms, for example, commonly used terms defined in the dictionary, are to be construed to have exactly the same meaning as that of related technology in the context. As long as terms are not clearly defined in the present application, the terms should not be ideally or excessively construed as formal meaning.

Also, the embodiment is provided for giving those skilled in the art more complete description. Therefore, the shapes and sizes and the like of components of the drawings may be exaggerated for clarity of the description.

Figure 2:
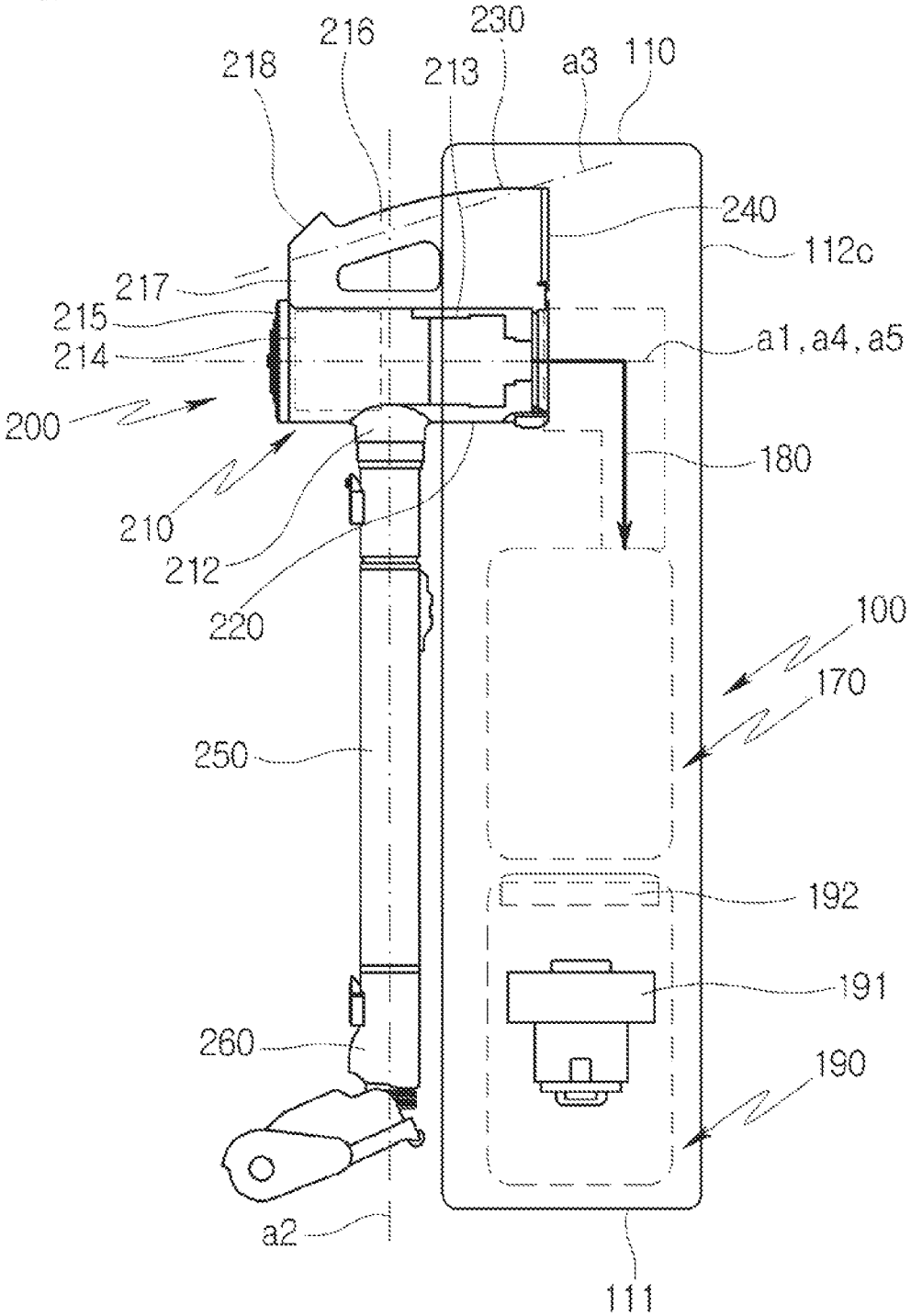
FIG. 2 is a schematic view of a configuration of the cleaner system 10.

FIG. 1 is a perspective view of a cleaner system 10 including a cleaner station 100 and a cleaner. FIG. 2 is a schematic view of a configuration of the cleaner system 10.

Referring to FIGS. 1 and 2, the cleaner system 10 according to the embodiment of the present disclosure includes the cleaner station 100 and a cleaner 200. Meanwhile, this embodiment may be implemented without some of the components and does not exclude additional components.

The cleaner system 10 may include the cleaner station 100. The cleaner 200 may be disposed in the cleaner station 100. The cleaner 200 may be coupled to a side of the cleaner station 100. Specifically, a body of the cleaner 200 may be coupled to the side of the cleaner station 100. The cleaner station 100 may remove dust of a dust bin 220 of the cleaner 200.

First, for the purpose of assisting the understanding of the cleaner station 100 of the present disclosure, the structure of the cleaner 200 will be described with reference to FIGS. 1 to 4.

The cleaner 200 may refer to a cleaner manually operated by a user. For example, the cleaner 200 may mean a hand cleaner or a stick cleaner.

The cleaner 200 may be mounted on the cleaner station 100. The cleaner 200 may be supported by the cleaner station 100. The cleaner 200 may be coupled to the cleaner station 100.

The cleaner 200 may include a body 210. The body 210 may include a body housing 211, a suction portion 212, a dust separator 213, a suction motor 214, an air discharge cover 215, a handle 216, an extension portion 217, and an operation unit 218.

The body housing 211 may form the exterior of the cleaner 200. The body housing 211 may provide a space capable of receiving the suction motor 214 and a filter (not shown) therein. The body housing 211 may be formed in a shape similar to a cylinder.

The suction portion 212 may protrude outward from the body housing 211. For example, the suction portion 212 may be formed in a cylindrical shape. The suction portion 212 may communicate with an extension tube 280. The suction portion 212 may provide a flow path through which dust-containing air can flow (hereinafter, may be referred to as a "suction flow path").

Meanwhile, in the embodiment, an imaginary centerline passing through the center of the cylindrical suction portion 212 may be formed. That is, an imaginary suction flow path centerline a2 passing through the center of the suction flow path may be formed.

Here, the suction flow path centerline a2 may be an imaginary line that connects the centers of gravity of planes obtained by cutting the suction portion 212 in the radial direction along the axial direction thereof.

The dust separator 213 may communicate with the suction portion 212. The dust separator 213 may separate dust sucked into the inside through the suction portion 212. The dust separator 213 may communicate with the dust bin 220.

For example, the dust separator 213 may be a cyclone capable of separating dust by cyclone flow. Also, the dust separator 213 may communicate with the suction portion 212. Accordingly, the air and dust sucked through the suction portion 212 flow spirally along the inner circumferential surface of the dust separator 213. Therefore, cyclone flow may occur with respect to the central axis of the dust separator 213.

The dust separator 213 may divide an inner space of the dust bin 220. The dust separator 213 may divide the inner space into a first dust separator 2131 and a second dust separator 2132. An air flow path is formed in the order of the suction portion—the first dust separator 2131—the second dust separator 2132 the suction motor a discharge portion.

The first dust separator 2131 is a component that primarily filters large dust included in the air sucked by the suction portion. The first dust separator 2131 communicates with the suction portion into which air flows.

A first cyclone is disposed in the first dust separator 2131. The first cyclone is a component to which the principle of a dust collector using centrifugal force is applied.

The first cyclone includes a cylindrical mesh net. The first cyclone is formed in a cylindrical shape based on a central axis thereof. The suction portion is formed in the circumferential direction of the first cyclone, and air is introduced in such a manner as to deviate from the central axis. The air sucked in through the suction portion moves spirally along the inner circumferential surface of the mesh net. Dust contained in the air is separated from the air due to the centrifugal force and accumulates in the lower portion of the first dust separator 2131. The air passes through the mesh net and is introduced into the second dust separator 2132.

The lower portion of the first dust separator 2131 communicates with an open side of the dust bin 220. Accordingly, large dust accumulated in the lower portion of the first dust separator 2131 is discharged to the outside through the open side of the dust bin 220.

The second dust separator 2132 is a component that secondarily filters fine dust contained in the air introduced from the first dust separator 2131. The second dust separator 2132 communicates with the first dust separator 2131. The second dust separator 2132 is disposed downstream of the first dust separator 2131.

A second cyclone is disposed in the second dust separator 2132. The second cyclone is a component to which the principle of a dust collector using centrifugal force is applied.

The second cyclone has an inner tube and an outer tube. Air is introduced into a gap between the inner tube and the outer tube at one end of the second cyclone.

A plurality of blades is disposed between the inner tube and the outer tube of the second cyclone. The plurality of blades rotates the air introduced into the gap between the inner tube and the outer tube, and the air moves spirally along the inner circumferential surface of the inner tube. Dust contained in the air is separated from the air due to the centrifugal force and accumulates in the lower portion of the second dust separator 2132. The air passes through an inner flow path of the inner tube and is discharged to the outside.

The lower portion of the first dust separator 2131 communicates with the open side of the dust bin 220. Accordingly, large dust accumulated in the lower portion of the first dust separator 2131 is discharged to the outside through the open side of the dust bin 220.

The first dust separator 2131 is disposed on the outer circumference of the second dust separator 2132. When the dust bin 220 is viewed from the discharge cover, the second dust separator 2132 is disposed at the center of the discharge cover, and the first dust separator 2131 has a shape surrounding the second dust separator 2132 at the outer circumference of the second dust separator 2132.

When the dust bin 220 is viewed from the discharge cover, the air introduced from the suction portion rotates within the first dust separator 2131 and flows into the second dust separator 2132 disposed on the radially inner side.

Meanwhile, as will be described later, the discharge cover according to the embodiment is composed of a first discharge cover 2221 and a second discharge cover 2226. The first discharge cover 2221 covers the lower portion of the first dust separator 2131, and the second discharge cover 2226 covers the lower portion of the second dust separator 2132. The second discharge cover 2226 may operate independently of the first discharge cover 2221. Therefore, after small dust collected in the second dust separator 2132 is first discharged, large dust collected in the first dust separator 2131 may be separately discharged. Details thereof will be described later.

Meanwhile, in the embodiment, the central axis of the cyclone may form an imaginary cyclone central axis line a4 extending in an up and down direction.

Here, the cyclone central axis line a4 may be an imaginary line that connects the centers of gravity of planes obtained by cutting the dust separator 213 in the radial direction along the axial direction thereof. For example, the cyclone central axis line a4 may be formed coaxially with a motor axis line a1 to be described later. The suction motor 214 may generate a suction force for sucking air. The suction motor 214 may be received within the body housing 211. The suction motor 214 may generate the suction force by rotation. For example, the suction motor 214 may be provided similarly to a cylindrical shape.

Meanwhile, in this embodiment, the imaginary motor axis line a1 extending from the central axis of the suction motor 214 may be formed.

Here, the motor axis line a1 may be an imaginary line that connects the centers of gravity of planes obtained by cutting the suction motor 214 in the radial direction along the axial direction thereof.

The air discharge cover 215 may be disposed on one side of the body housing 211 in the axial direction. A filter for filtering the air may be received in the air discharge cover 215. For example, a HEPA filter may be received in the air discharge cover 215.

An air outlet 215*a* may be formed in the air discharge cover 215. The air outlet 215*a* discharges the air sucked by the suction force of the suction motor 214.

A flow guide may be disposed on the air discharge cover 215. The flow guide may guide the flow of the air discharged through the air outlet 215*a*.

The handle 216 can be gripped by a user. The handle 216 may be disposed at the rear of the suction motor 214. For example, the handle 216 may be formed in a shape similar to a cylinder. Alternatively, the handle 216 may be formed to have a curved cylindrical shape. The handle 216 may be disposed at a predetermined angle with the body housing 211, the suction motor 214, or the dust separator 213.

Meanwhile, in the embodiment, an imaginary handle axis line a3 extending from the central axis of the handle 216 may be formed.

Here, the handle axis line a3 may be an imaginary line that connects the centers of gravity of planes obtained by cutting the handle 216 in the radial direction along the axial direction thereof.

A shaft of the suction motor 214 may be disposed between the suction portion 212 and the handle 216. That is, the motor axis line a1 may be disposed between the suction portion 212 and the handle 216.

Also, the handle axis line a3 may be disposed at a predetermined angle with the motor axis line a1 or the suction flow path centerline a2. Accordingly, there may be present an intersection where the handle axis line a3 intersects the motor axis line a1 or the suction flow path centerline a2.

Meanwhile, the motor axis line a1, the suction flow path centerline a2, and the handle axis line a3 may be disposed on the same plane S1.

Meanwhile, in the embodiment of the present disclosure, the front may refer to a direction in which the suction portion 212 is disposed based on the suction motor 214, and the rear may refer to a direction in which the handle 216 is disposed.

The upper surface of the handle 216 may form a portion of the exterior of the upper surface of the cleaner 200. Through this, when the user grips the handle 216, a component of the cleaner 200 can be prevented from coming into contact with the user's arm.

The extension portion 217 may extend from the handle 216 toward the body housing 211. At least a portion of the extension portion 217 may extend in a horizontal direction.

The operation unit 218 may be disposed on the handle 216. The operation unit 218 may be disposed on an inclined surface formed in a top area of the handle 216. The user can input an operation command or a stop command of the cleaner 200 through the operation unit 218.

The cleaner 200 may include the dust bin 220. The dust bin 220 may communicate with the dust separator 213. The dust bin 220 may store the dust separated by the dust separator 213.

The dust bin 220 may include a dust bin body 221 and a discharge cover 222.

The dust bin body 221 may provide a space for storing the dust separated by the dust separator 213. For example, the dust bin body 221 may be formed similarly to a cylindrical shape.

Meanwhile, in the embodiment, an imaginary dust bin axis line a5 extending from the central axis of the dust bin body 221 may be formed.

Here, the dust bin axis line a5 may be an imaginary line that connects the centers of gravity of planes obtained by cutting the dust bin 220 in the radial direction along the axial direction thereof. For example, the dust bin axis line a5 may be formed coaxially with the motor axis line a1.

Accordingly, the dust bin axis line a5 may also be disposed on the plane S1 that is formed to include the motor axis line a1, the suction flow path centerline a2, and the handle axis line a3.

A portion of the bottom surface of the dust bin body 221 may be opened. Also, a bottom surface extension portion 221*a* may be formed on the bottom surface of the dust bin body 221. The bottom surface extension portion 221*a* may be formed to partially block the bottom surface of the dust bin body 221.

A side of the dust bin 220 perpendicular to the ground may be opened based on when the cleaner is mounted on the cleaner station 100. By having such an arrangement, the discharge cover 222 is not opened by gravity. Therefore, there is an effect of preventing the risk that the discharge cover 222 is opened due to malfunction when the user does not desire.

The dust bin 220 may include the discharge cover 222. The discharge cover is a component that covers the open bottom side of the dust bin 220. The dust bin 220 collects dust within the dust bin 220 when the cleaner is operated. After the operation is stopped, the dust bin is opened only when necessary and discharges the collected dust.

The discharge cover 222 may be disposed on the bottom surface of the dust bin 220. The discharge cover 222 may selectively open and close the lower portion of the dust bin 220 that is opened downward.

Based on when the cleaner is mounted on the cleaner station, the discharge cover is disposed at the rear of the cleaner. The cleaner is mounted on the cleaner station such that the dust bin axis line a5 is parallel to the ground, and the discharge cover is disposed at the rear of the cleaner in a direction perpendicular to the ground. Thus, the dust is discharged to the rear of the cleaner.

The discharge cover 222 may include cover bodies 2221 and 2226 and hinges 2222 and 2227. The cover bodies 2221 and 2226 may be formed to partially block the bottom surface of the dust bin body 221. The cover bodies 2221 and 2226 may rotate based on the hinges 2222 and 2227. The hinges 2222 and 2227 may be disposed adjacent to a battery 240. The discharge cover 222 may be coupled to the dust bin 220 through hook coupling.

Meanwhile, the dust bin 220 may further include a coupling lever 2224. The discharge cover 222 can be separated from the dust bin 220 through the coupling lever 2224. The coupling lever 2224 may be disposed opposite to the hinge. For example, when the hinges 2222 and 2227 are disposed at the rear end of the dust bin body 221, the coupling lever 2224 may be disposed at the front end of the dust bin body 221. Specifically, the coupling lever 2224 may be disposed on the front outer surface of the dust bin 220. When an external force is applied, the coupling lever 2224 may elastically deform a hook extending from the cover body 2221 in order to release the hook coupling between the cover body 2221 and the dust bin body 221.

When the discharge cover 222 is closed, the bottom surface of the dust bin 220 may be blocked (sealed) by the discharge cover 222 and the bottom surface extension portion 221*a*.

Figure 8:
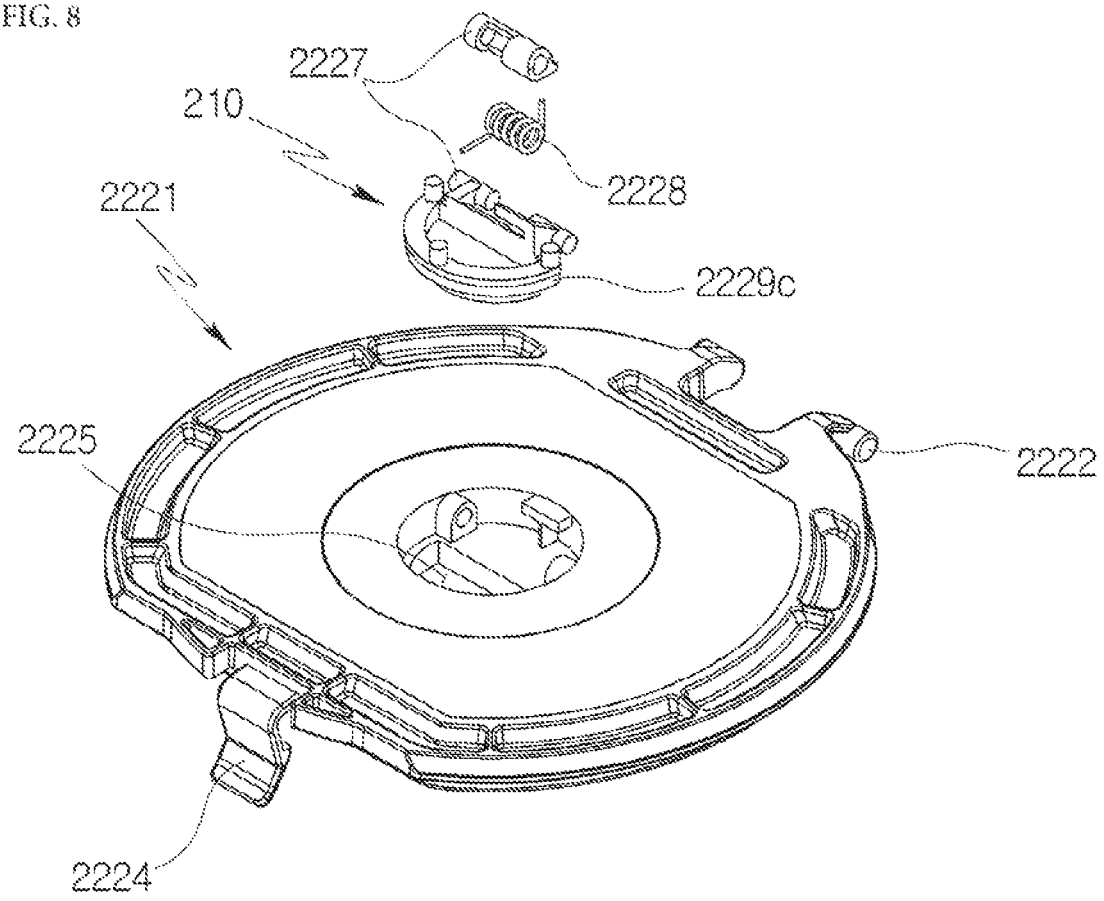
FIG. 8 is an exploded perspective view showing that the second discharge cover is separated from adjacent components.

Referring to FIG. 8, the discharge cover includes the first discharge cover 2221 and the second discharge cover 2226.

The first discharge cover 2221 covers a portion of the open side of the dust bin 220, and the second discharge cover 2226 covers the rest portion of the open side of the dust bin 220. Both the first discharge cover 2221 and the second discharge cover 2226 seal the open side of the dust bin 220.

The bottom surface of the first discharge cover 2221 and the bottom surface of the second discharge cover 2226 may be disposed on the same plane.

Figure 3:
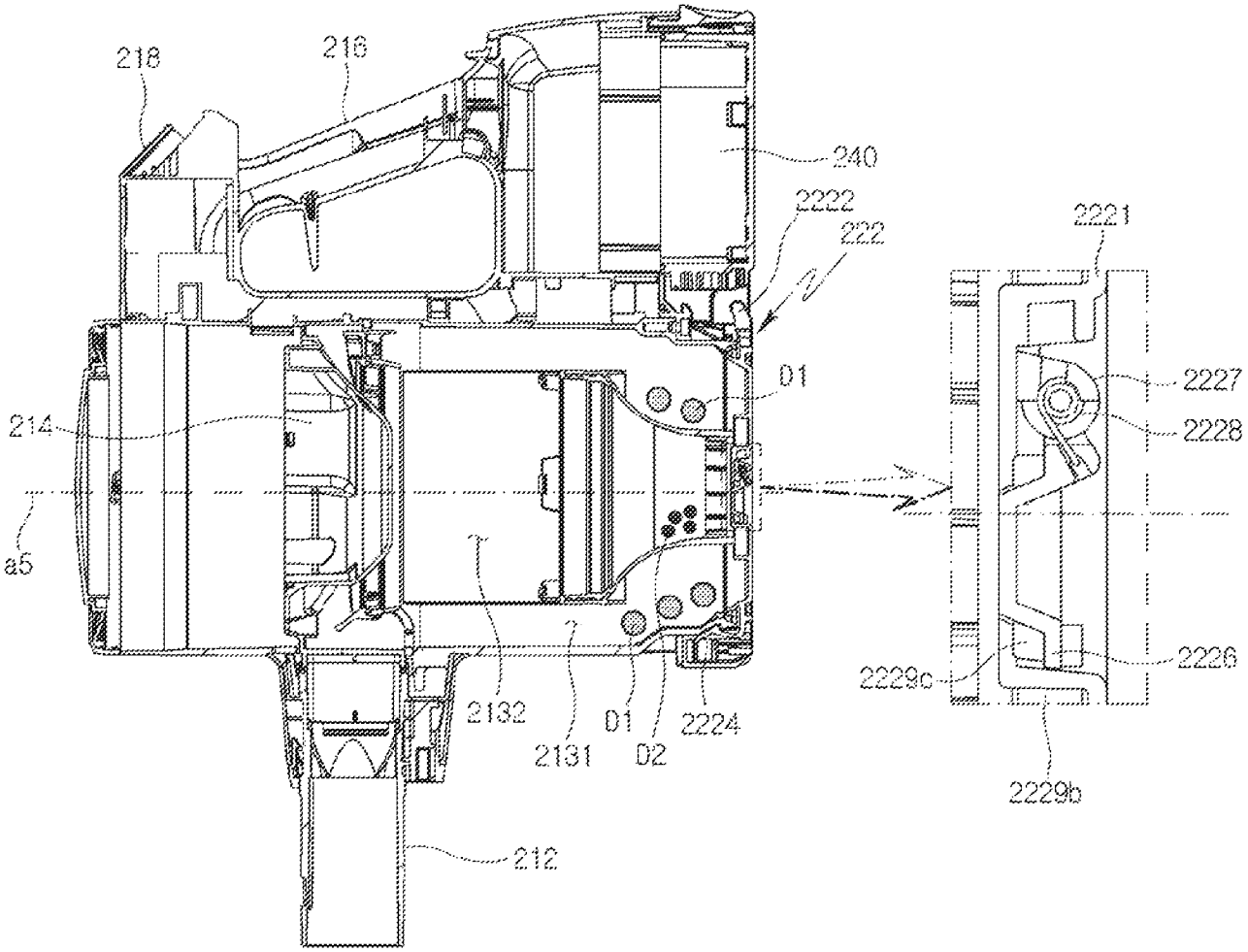
FIG. 3 is a view showing a dust bin in a state where a discharge cover is closed, as viewed from a side of the dust bin.
Figure 4:
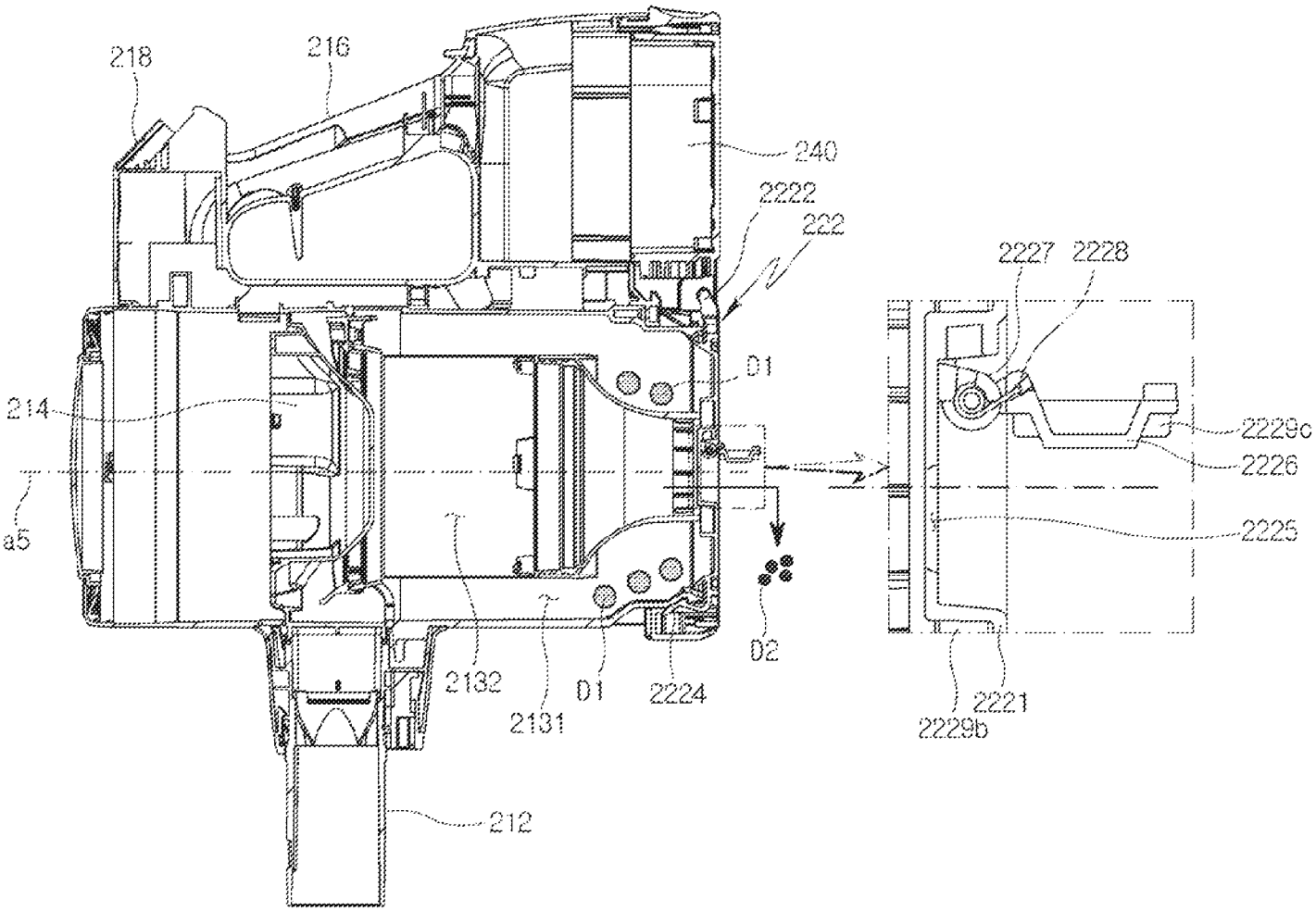
FIG. 4 is a view showing the dust bin in a state where a second discharge cover is closed in FIG. 3, as viewed from a side of the dust bin.
Figure 5:
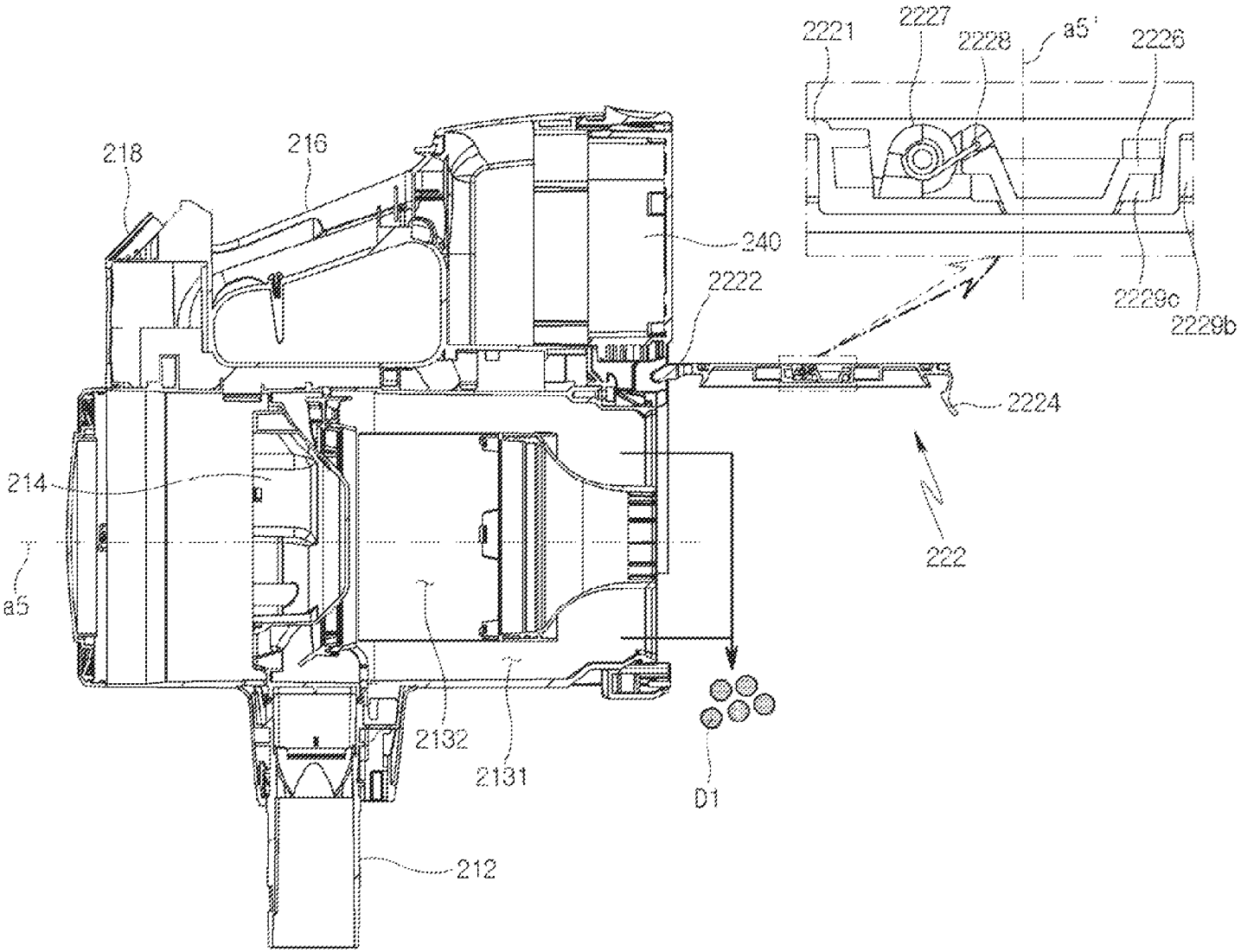
FIG. 5 is a view showing the dust bin in a state where a first discharge cover is closed in FIG. 4, as viewed from a side of the dust bin.

FIG. 3 is a view showing the dust bin 220 in a state where the discharge cover is closed, as viewed from a side of the dust bin. FIG. 4 is a view showing the dust bin 220 in a state where the second discharge cover 2226 is closed, as viewed from a side of the dust bin. FIG. 5 is a view showing the dust bin in a state where the first discharge cover 2221 is closed, as viewed from a side of the dust bin 220.

Referring to FIGS. 3 to 5, the inner space of the dust bin 220 is divided into the first dust separator 2131 and the second dust separator 2132. Here, the first discharge cover 2221 covers an area that communicates with the first dust separator 2131 in the open side of the dust bin 220, and the second discharge cover 2226 covers an area that communicates with the second dust separator 2132 in the open side of the dust bin 220.

When the dust bin 220 is viewed from the bottom of the dust bin 220, an area including the dust bin axis line a5 corresponds to the second dust separator 2132, and an area formed by the outer circumferential surface of the second dust separator 2131 and the inner circumferential surface of the dust bin body 221 corresponds to the second dust separator 2132. As such, the inner space of the dust bin 220 is divided into the first dust separator 2131 and the second dust separator 2132.

The second discharge cover 2226 includes the dust bin axis line a5 in the open side of the dust bin 220, covers a central area that communicates with the second dust separator 2132, and selectively discharges fine dust filtered by the second dust separator 2132.

The first discharge cover 2221 covers an area that communicates with the first dust separator 2131 in the open side of the dust bin 220. The area may have a shape similar to a donut. When the first discharge cover 2221 is opened, large dust filtered by the first dust separator 2131 is discharged by negative pressure.

The first dust separator 2131 may be disposed on the outer circumference of the second dust separator 2132. Based on the mesh net, the second dust separator 2132 is disposed within the mesh net, and the first dust separator 2131 is formed outside the mesh net. Therefore, the second discharge cover 2226 may be first opened to suck fine dust (small dust) collected in the second dust separator 2132, and then the first discharge cover 2221 may be opened to suck the fine dust (small dust) collected in the second dust separator 2132 and large dust collected in the first dust separator 2131. Since fine dust (small dust) has a greater adsorption force than that of large dust, fine dust (small dust) can be more efficiently sucked through a small through-hole 2225 of the first discharge cover.

Referring to FIG. 8, the through-hole 2225 is formed in one side of the first discharge cover 2221. The second discharge cover 2226 is disposed in the through-hole 2225 of the first discharge cover and selectively seals the through-hole 2225.

The through-hole 2225 is formed smaller than the area that communicates with the second dust separator 2132 in the open side of the dust bin 220. Through such an arrangement, when the second discharge cover 2226 is opened, only small dust collected in the first dust separator 2131 can be sucked in.

When the through-hole 2225 is viewed from the bottom thereof, the through-hole 2225 may be formed in a partial circle shape. For example, the through-hole 2225 may have a semicircular cross section. The through-hole 2225 may be convex downward based on when the cleaner is mounted on the cleaner station. In the second dust separator 2132, small dust accumulates in the front of the dust bin 220, that is, in the lower portion based on when the cleaner is mounted on the cleaner station. The through-hole 2225 is formed convex downward, so that small dust can be easily sucked.

A depressed portion that is formed to be depressed into the dust bin 220 is formed on one side of the first discharge cover 2221, and the through-hole 2225 may be formed in the depressed portion.

A second sealer 2229*b* (sealer) is disposed on the outer circumferential surface of the depressed portion in the inner surface of the first discharge cover 2221. The second sealer 2229*b* comes into close contact with an end of a separation wall on which the mesh net is disposed and which divides the first dust separator 2131 and the second dust separator 2132. A first sealer 2229*a* prevents large dust collected in the first dust separator 2131 and small dust collected in the second dust separator 2132 from mixing with each other.

Figure 6:
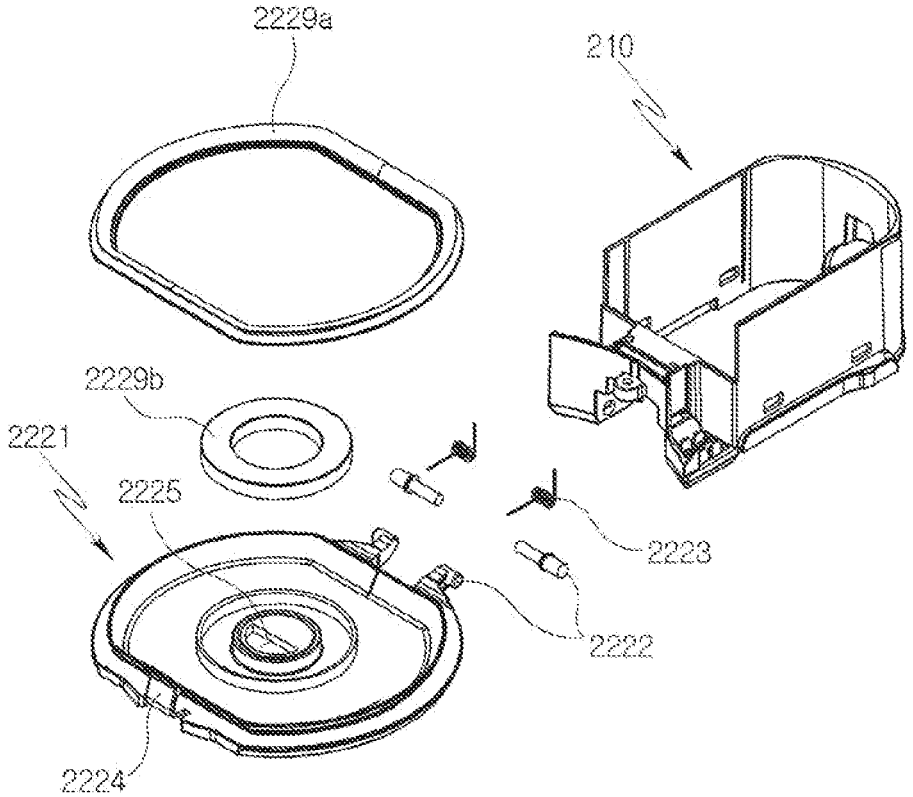
FIG. 6 is an exploded perspective view showing that the discharge cover is separated from adjacent components.
Figure 7:
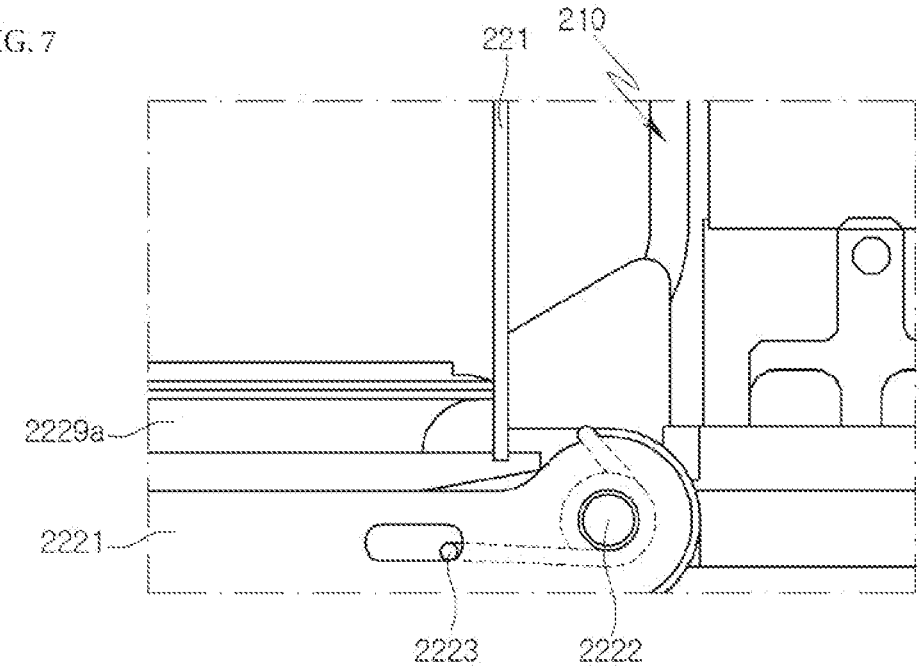
FIG. 7 is an enlarged view showing that the first discharge cover is coupled to the dust bin.

Referring to FIGS. 6 and 7, the first discharge cover 2221 includes the first hinge 2222 and the coupling lever 2224.

The first hinge 2222 is a component that opens and closes the dust bin 220 by rotating the first discharge cover 2221.

Referring to FIG. 6, the first hinge 2222 is disposed on the top of the first discharge cover 2221 when the cleaner is mounted on the cleaner station. The first hinge 2222 is disposed on the top of the first discharge cover 2221 and connects the top of the first discharge cover 2221 and the top of the dust bin body 221. Accordingly, when the dust bin 220 is opened, the first discharge cover 2221 separates from the lower portion of the dust bin body 221.

When the cleaner is mounted on the cleaner station, large dust accumulates in the lower portion of the dust bin 220 by gravity. When the lower portion of the first discharge cover 2221 and the lower portion of the dust bin body 221 are connected, the first hinge 2222 is covered with dust. Therefore, the first hinge 2222 is disposed not on the bottom but on the top of the first discharge cover 2221.

The first discharge cover 2221 rotates outward and upward with the first hinge 2222 as a rotational axis to open the dust bin 220. Referring to the drawing, the first discharge cover 2221 rotates counterclockwise (CCW) to open the dust bin, and rotates clockwise (CW) to close the dust bin 220. If the first discharge cover 2221 is designed to be opened toward the inside of the dust bin 220, the suction flow path is formed below the dust bin 220 by a dust collection motor. A subatmospheric pressure of the dust collection motor is applied in a direction opposite to a direction in which the first discharge cover 2221 is opened, so that the first discharge cover 2221 does not open. Accordingly, in order to open the dust bin 220 by a smaller force, the first discharge cover 2221 rotates outward and upward to open the dust bin 220.

Referring to FIG. 7, a first elastic member 2223 may be disposed on the first hinge 2222.

The first elastic member 2223 is disposed on the first hinge 2222 and provides an elastic force to the first discharge cover 2221 in a direction of opening the dust bin 220. Referring to the drawing, the first elastic member 2223 applies a force to the first discharge cover 2221 in a counterclockwise direction (CCW). Accordingly, when the coupling lever 2224 is operated and the fixing of the first discharge cover 2221 and the dust bin 220 is released, the first elastic member 2223 pushes the first discharge cover 2221 upward.

The first elastic member 2223 may be a torsion spring. The first elastic member 2223 may be disposed by winding at least a portion of a rod of the first hinge 2222.

The first elastic member 2223 has a sufficient modulus of elasticity to push up the first discharge cover 2221 against the weight of the first discharge cover 2221. The first elastic member 2223 has a sufficient modulus of elasticity in order to prevent the first discharge cover 2221 from returning downward due to the subatmospheric pressure of the dust collection motor.

Referring to FIGS. 2 and 3, the coupling lever 2224 is a component that fixes or releases the first discharge cover 2221 to or from the dust bin 220.

When the cleaner is mounted on the cleaner station, the coupling lever 2224 is disposed below the first discharge cover 2221.

The coupling lever 2224 is disposed opposite to the first hinge 2222. Assuming that the discharge cover is disposed on the bottom surface of the dust bin 220, the coupling lever 2224 is disposed at the front end of the first discharge cover 2221, and the first hinge 2222 is disposed at the rear end of the first discharge cover 2221. In contrast, assuming that the cleaner is mounted on the cleaner station, the coupling lever 2224 is disposed below the first discharge cover 2221, and the first hinge 2222 is disposed on the top of the first discharge cover 2221.

The cleaner station may include a cover opening unit (not shown). The cover opening unit is fastened to the engagement lever 2224. The cover opening unit moves the coupling lever 2224 to release the fixation of the first discharge cover 2221 and the dust bin body 221.

The cover opening unit is controlled by a controller. The controller may transmit a signal to the cover opening unit to operate the cover opening unit and may open the first discharge cover 2221.

Referring to FIG. 5, for example, one side of the coupling lever 2224 is fixed by being caught by one side of the dust bin 220. The cover opening unit moves to the right between the coupling lever 2224 and the dust bin 220. When the cover opening unit moves to the right, the end of the coupling lever 2224 is lifted up to the outside of the dust bin 220, and the catch of the coupling lever 2224 and the dust bin 220 is released. When the catch of the coupling lever 2224 and the dust bin 220 is released, the first discharge cover is opened by the elastic force of the first sealer 2229*a* or the second sealer 2229*b* or by the elastic force of the first elastic member 2223.

The first hinge 2222 is disposed on the top of the first discharge cover 2221 based on when the cleaner is mounted on the cleaner station. Therefore, when the first discharge cover 2221 is opened, the first discharge cover 2221 rotates and is placed on the upper portion of the flow path. Therefore, when air flows, there is an effect of minimizing air resistance. Also, when the dust is discharged, there is an effect of preventing that the dust collides with the first discharge cover 2221 and is adsorbed on the first discharge cover 2221.

Referring to FIG. 8, the second discharge cover 2226 includes the second hinge 2227. The second hinge 2227 is a component that opens and closes the dust bin 220 by rotating the second discharge cover 2226.

The second hinge 2227 is disposed on the top of the first discharge cover 2221 when the cleaner is mounted on the cleaner station. The second hinge 2227 may include a downwardly convex curved portion and a straight portion that connects both ends of the curved portion. In this case, the second hinge 2227 may be disposed on the straight portion.

The second hinge 2227 is disposed on the top of the second discharge cover 2226 and connects the top of the second discharge cover 2226 and the first discharge cover 2221. Accordingly, when a portion of the dust bin 220 is opened, the second discharge cover 2226 separates from the lower portion of the first discharge cover 2221.

When the cleaner is mounted on the cleaner station, small dust accumulates in the lower portion of the dust bin by gravity. When the lower portion of the second discharge cover 2226 and the lower portion of the dust bin body 221 are connected, the second hinge 2227 is covered with dust. Therefore, it is preferable that the second hinge 2227 should be disposed not on the bottom but on the top of the second discharge cover 2226.

The second discharge cover 2226 is opened in a direction opposite to a direction in which the dust bin body 221 is located. The second discharge cover 2226 rotates outward and upward with the second hinge 2227 as a rotational axis to open a portion of the dust bin 220. Referring to FIG. 4, the second discharge cover 2226 rotates counterclockwise (CCW) to open a portion of the dust bin, and rotates clockwise (CW) to close a portion of the dust bin 220. The second discharge cover 2226 is opened by the subatmospheric pressure generated by the dust collection motor. The second discharge cover is designed to open in the opposite direction to the dust bin body 221. By having this arrangement, the second discharge cover 2226 can be opened and closed without including a separate module for opening and closing the second discharge cover 2226.

According to the embodiment, a second elastic member 2228 may be disposed on the second hinge 2227.

The second elastic member 2228 is disposed on the second hinge 2227. Unlike the first elastic member 2223, the second elastic member provides an elastic force to the second discharge cover 2226 in a direction of closing the dust bin 220. Referring to the drawing, the second elastic member 2228 applies a force to the second discharge cover 2226 in a clockwise direction (CW). Accordingly, when the cleaner operates, the second elastic member seals the second dust separator 2132, so that the dust is prevented from flowing out to the outside.

The second elastic member 2228 may be a torsion spring. The second elastic member 2228 may be disposed by winding at least a portion of a rod of the second hinge 2227.

During the operation of the cleaner, the second elastic member 2228 has a sufficient modulus of elasticity to bring the second discharge cover 2226 into close contact with the first discharge cover 2221 against the weight of the second discharge cover 2226.

The second elastic member 2228 has a sufficiently low modulus of elasticity such that the second discharge cover 2226 is opened by the subatmospheric pressure of the dust collection motor.

Since the suction motor operates during the operation of the cleaner, a subatmospheric pressure is generated in the inner space of the dust bin 220. The subatmospheric pressure formed within the dust bin 220 pulls the second discharge cover 2226 into the dust bin 220. Accordingly, the second elastic member 2228 can have a sufficiently low modulus of elasticity.

The elastic force required for the second elastic member 2228 is as follows. The elastic force provided by the second elastic member 2228 to the second discharge cover 2226 must be greater than a force obtained by subtracting the subatmospheric pressure generated by the suction motor from the weight of the second discharge cover 2226. This intends to prevent the second discharge cover 2226 from being opened while the cleaner is operating. However, the elastic force provided by the second elastic member 2228 must be less than a force obtained by subtracting the weight of the second discharge cover 2226 from the subatmospheric pressure generated by the dust collection motor. This intends to allow the second discharge cover 2226 to be opened when the dust bin 220 is cleaned. The modulus of elasticity of the second elastic member 2228 may be determined in consideration of the weight of the second discharge cover 2226, the power of the suction motor, and the power of the dust collection motor. The modulus of elasticity of the second elastic member 2228 may be determined through experiments.

Referring to FIGS. 4 and 8, the second discharge cover 2226 may further include a third sealer 2229*c*. The third sealer 2229*c* is disposed on the outer circumferential surface of the second discharge cover 2226. The third sealer 2229*c* brings the second discharge cover 2226 into closer contact with the first discharge cover 2221 and prevents that the second discharge cover 2226 collides with the first discharge cover 2221 and is damaged.

According to another embodiment of the present disclosure, at least a portion of the second discharge cover 2226 may be made of an elastic material. In this case, the second elastic member 2228 may not be disposed.

According to a first embodiment, the discharge cover is made of a hard material, and may be made of, for example, a plastic material. More specifically, both the first discharge cover 2221 and the second discharge cover 2226 may be made of a hard material. Since the dust bin 220 may be crushed by the subatmospheric pressure generated by the suction motor, the discharge cover is made of a hard material to resist the subatmospheric pressure generated by the suction motor.

However, unlike the first embodiment, in a second embodiment, while the first discharge cover 2221 may be made of a hard material, the second discharge cover 2226 may be made of an elastic material. Since an area occupied by the second discharge cover 2226 in the discharge cover is sufficiently smaller than an area occupied by the first discharge cover 2221, the second discharge cover 2226 can resist deformation even under subatmospheric pressure below a certain level. Even if the second discharge cover 2226 is partially depressed inward, the inner space of the dust bin 220 is not affected.

According to the second embodiment, the second discharge cover 2226 does not need to include a separate sealer for close contact with the first discharge cover 2221, nor does the second discharge cover 2226 need to include the second elastic member 2228 separately.

An area covered by the first discharge cover 2221 in the open side of the dust bin 220 is larger than an area covered by the second discharge cover 2226 in the open side of the dust bin 220. By having such an arrangement, there is an effect that it is possible to suck large dust and small dust more efficiently.

More specifically, small dust may be adsorbed on the wall surface of the second dust separator 2132 by electrostatic force or the like. Here, in order to suck the small dust, a stronger subatmospheric pressure should be required. The area covered by the second discharge cover 2226 is made less than the area covered by the first discharge cover 2221, so that a stronger subatmospheric pressure can be applied to the second dust separator 2132, and small dust can be discharged. Unlike small dust, large dust collected in the first dust separator 2131 can be discharged by a relatively low subatmospheric pressure. Therefore, there is an effect that limited electric power is concentrated on sucking small dust and the dust within the dust bin 220 can be more efficiently sucked.

Referring to FIGS. 3 and 6, the sealer disposed in the present disclosure will be described.

The first sealer 2229*a* is disposed in a gap between the first discharge cover 2221 and the first dust separator 2131. The first sealer 2229*a* is installed on the inner surface of the first discharge cover 2221. The first sealer 2229*a* protrudes inward or outward from the first discharge cover 2221, and the protruding end contacts the first dust separator 2131 to seal the inner space. Referring to FIG. 3, the protruding end of the first sealer 2229*a* contacts the inner circumferential surface of the dust bin body 221.

The second sealer 2229*b* is disposed in a gap between the first discharge cover 2221 and the second dust separator 2132. The second sealer 2229*b* is disposed on the outer circumferential surface of the depressed portion in the inner surface of the first discharge cover 2221. The second sealer 2229*b* comes into close contact with an end of the separation wall on which the mesh net is disposed and which divides the first dust separator 2131 and the second dust separator 2132. The first sealer 2229*a* prevents large dust collected in the first dust separator 2131 and small dust collected in the second dust separator 2132 from mixing with each other.

The third sealer 2229*c* is disposed in a gap between the first discharge cover 2221 and the second discharge cover 2226. The third sealer 2229*c* is disposed on a surface where the second discharge cover 2226 and the first discharge cover 2221 face each other. The third sealer 2229*c* is disposed along the outer circumferential surface of the second discharge cover 2226. The third sealer 2229*c* seals the gap between the second discharge cover 2226 and the first discharge cover 2221 to prevent the second dust separator 2132 from being discharged unintentionally. In addition, the third sealer 2229*c* can perform a buffer function of mitigating a collision with the first discharge cover 2221 when the second discharge cover 2226 is closed again after being opened.

The controller may transmit a command to the cleaner or the cleaner station, thereby discharging dust collected in the dust bin 220 of the cleaner.

When the cleaner is coupled to the cleaner station, the controller operates the dust collection motor disposed within the cleaner station with a first power or higher (S110).

Since a detection sensor is disposed in the cleaner station, the controller can detect that the cleaner is coupled to the cleaner station. The controller may not only operate a fixing unit (not shown) to fix the cleaner to the cleaner station may but also seal a gap between the cleaner and the cleaner station.

After the cleaner comes into close contact with the cleaner station, the controller operates the dust collection motor. When the dust collection motor is operated, a subatmospheric pressure is generated in a flow path portion 180 between the dust bin 220 and the dust collection motor. When the dust collection motor is operated with the first power or higher, the subatmospheric pressure exceeds a force obtained by adding the weight of the second discharge cover 2226 to the elastic force of the second elastic member 2228, and accordingly, the second elastic member 2228 rotates outward or deforms. When the second elastic member 2228 rotates or deforms, the flow path portion 180 and the second dust separator 2132 communicate with each other. As a result, small dust collected in the second dust separator 2132 by the subatmospheric pressure is discharged to the outside through the flow path portion 180.

According to the embodiment of the present disclosure, unlike other generally known technologies, considering the fact that only a portion of the open side of the dust bin 220 communicates, the fact that the cross-sectional area of the open side is sufficiently small, so that the flow rate and subatmospheric pressure are sufficiently large, and the fact that small dust, i.e., adsorbed dust is first sucked, small dust collected in the second dust separator 2132 can be efficiently discharged.

The controller may open the first discharge cover 2221 after a predetermined time has elapsed (S120).

The "predetermined time" is a time which is recognized to allow the small dust collected in the second dust separator 2132 to be sufficiently discharged, and is determined by experiments.

The controller may open the first discharge cover 2221 by operating the cover opening unit (not shown). When the first discharge cover 2221 is opened, no subatmospheric pressure acts on the second discharge cover 2226 anymore. As a result, the second discharge cover 2226 is closed by a restoring force of the second elastic member 2228. When the first discharge cover 2221 is opened, the first dust separator 2131 and the flow path portion 180 communicate with each other, and large dust collected within the first dust separator 2131 is discharged by subatmospheric pressure. Meanwhile, even in this case, since the second dust separator 2132 and the flow path portion 180 are still in communication with each other, it is obvious that small dust remaining within the second dust separator 2132 can be discharged.

The cleaner 200 may include the battery 240.

The battery 240 may be detachably coupled to the cleaner 200.

The battery 240 may supply power to the suction motor 214 of the cleaner 200. Battery 240 may be disposed below the handle 216. The battery 240 may be disposed at the rear of the dust bin 220. That is, the suction motor 214 and the battery 240 may be arranged so as not to overlap in an up and down direction and may also have different arrangement heights. Based on the handle 216, the heavy suction motor 214 is disposed in front of the handle 216 and the heavy battery 240 is disposed below the handle 216, so that is the overall weight of the cleaner 200 can be evenly distributed. Through this, when the user cleans while gripping the handle 216, the user's wrist can be prevented from being strained.

The cleaner 200 may include an extension tube 250. The extension tube 250 may communicate with a cleaning module 260. The extension tube 250 may communicate with the body 210. The extension tube 250 may communicate with the suction portion 212 of the body 210. The extension tube 250 may be formed in a long cylindrical shape.

The body 210 may be connected to the extension tube 250. The body 210 may be connected to the cleaning module 260 through the extension tube 250. The body 210 may generate a suction force by the suction motor 214 and may provide the suction force to the cleaning module 260 through the extension tube 250. External dust may enter the body 210 through the cleaning module 260 and the extension tube 250.

The cleaner 200 may include the cleaning module 260. The cleaning module 260 may communicate with the extension tube 250. Accordingly, external air may flow into the body 210 of the cleaner 200 through the cleaning module 260 and the extension tube 250 by the suction force generated by the body 210 of the cleaner 200.

Dust within the dust bin 220 of the cleaner 200 may be collected to a dust collector 170 of the cleaner station 100 by gravity and the suction force of the dust collection motor 191. Through this, since the dust within the dust bin 220 can be removed without a separate operation of the user, convenience for users can be provided. In addition, it is possible to remove the inconvenience for the user to empty the dust bin 220 each time. Also, the dust can be prevented from scattering during the emptying of the dust bin 220.

The cleaner 200 may be coupled to the side of a housing 110. Specifically, the body 210 of the cleaner 200 may be mounted on a coupling portion 120. More specifically, the battery 240 and the dust bin 220 of the cleaner 200 may be coupled to a coupling surface 121, and the outer circumferential surface of the dust bin body 221 may be coupled to a dust bin guide surface 122. The suction portion 212 may be coupled to a suction portion guide surface 126 of the coupling portion 120 (See FIG. 2).

Meanwhile, FIGS. 1 and 2 are views for describing an arrangement relationship between a center of gravity of the cleaner and the cleaner station according to the embodiment of the present disclosure.

Referring to FIGS. 1 and 2, the cleaner station 100 according to the embodiment of the present disclosure will be described as follows.

The cleaner 200 may be disposed in the cleaner station 100. The cleaner 200 may be coupled to a side of the cleaner station 100. Specifically, the body of the cleaner 200 may be coupled to the side of the cleaner station 100. The cleaner station 100 may remove dust of the dust bin 220 of the cleaner 200.

The cleaner station 100 may include the housing 110. The housing 110 may form the exterior of the cleaner station 100. Specifically, the housing 110 may be formed in a column shape including at least one outer wall surface. For example, the housing 110 may be formed in a shape similar to a quadrangular column.

The housing 110 may have a space capable of receiving a dust collector 130 that stores dust therein and a dust suction module 190 that generates a flow force for collecting dust to the dust collector 130.

The housing 110 may include a bottom surface 111 and an outer wall surface 112.

The bottom surface 111 may support the lower portion in the gravity direction of the dust suction module 190. That is, the bottom surface 111 may support the lower portion of a dust collection motor 191 of the dust suction module 190.

Here, the bottom surface 111 may be placed toward the ground. The bottom surface 111 can be disposed to be inclined at a predetermined angle to the ground as well as can be placed parallel to the ground. With such a configuration, the bottom surface is able to stably support the dust collection motor 191, and is able to balance the overall weight even when the cleaner 200 is coupled.

The outer wall surface 112 may mean a surface formed in the direction of gravity, and may mean a surface connected to the bottom surface 111. For example, the outer wall surface 112 may mean a surface connected perpendicular to the bottom surface 111. In another embodiment, it is possible that the outer wall surface 112 is disposed to be inclined at a predetermined angle with the bottom surface 111.

The outer wall surface 112 includes a front surface 112*a* and a side surface 112*c*.

The cleaner station 100 may include the coupling portion 120 for coupling the cleaner 200. Specifically, the coupling portion 120 may be disposed on the front side of the cleaner station, and the body 210, the dust bin 220, and the battery 240 of the cleaner 200 may be coupled to the coupling portion 120.

The coupling portion 120 may refer to a surface formed in a shape of a groove concave toward the inside of the cleaner station 100.

The cleaner 200 may be coupled to the coupling portion 120. For example, the coupling portion 120 may be in contact with the lower surface of the battery 240 and the dust bin 220 of the cleaner 200. Here, the lower surface may mean a surface facing the ground when the user uses the cleaner 200 or puts it on the ground.

For example, an angle between the coupling portion 120 and the ground may be a right angle. Through this, when the cleaner 20) is coupled to the coupling portion 120, the space of the cleaner station 100 can be minimized.

As another example, the coupling portion 120 may be disposed to be inclined at a predetermined angle to the ground. Through this, when the cleaner 200 is coupled to the coupling portion 120, the cleaner station 100 can be stably supported.

The coupling unit 120 may include a coupling sensor (not shown). The coupling sensor can detect whether or not the cleaner 200 is coupled to the coupling portion 120.

The coupling sensor may include a contact sensor. For example, the coupling sensor may include a micro switch.

Meanwhile, the coupling sensor may also include a non-contact sensor. For example, the coupling sensor may include an infrared ray (IR) sensor.

The coupling sensor may be a means for determining both whether electric power is applied to the battery 240 of the cleaner 200 and whether the cleaner 200 is coupled.

Referring to the drawings, a control configuration of the present disclosure will be described.

The cleaner station 100 according to the embodiment of the present disclosure may further include the controller 400 that controls the coupling portion 120, a fixing unit (not shown), a door unit (not shown), a cover opening unit (not shown), the dust collector 170, a flow path portion 180, and a dust suction module 190.

The controller 400 may be received within the housing 110.

The controller 400 may be disposed on the upper side of the inside of the housing 110. For example, the controller 400 may be disposed in the coupling portion 120. Through this arrangement, the controller 400, the fixing unit (not shown), the door unit (not shown), and the cover opening unit (not shown) are disposed close to each other, so that a response performance can be improved.

Unlike this, the controller 400 may be disposed on the lower side of the inside of the housing 110. For example, the controller 400 may also be disposed in the dust suction module 190. Through this arrangement, the controller 400 is disposed close to the relatively heavy dust collection motor 191 and disposed close to the ground. Therefore, since the controller can be stably supported, the controller can be prevented from being damaged even when an external impact is applied.

The controller 400 may be composed of a printed circuit board and devices mounted on the printed circuit board.

When the coupling sensor detects the coupling of the cleaner 200, the coupling sensor may transmit a signal indicating that the cleaner 200 is coupled to the coupling portion 120. Here, the controller 400 may receive the signal of the coupling sensor and determine that the cleaner 200 is coupled to the coupling portion 120 (S100).

Also, when electric power is supplied to the battery 240 of the cleaner 200 from a charging part, the controller 400 may determine that the cleaner 200 is coupled to the coupling portion 120.

When it is determined that the cleaner 200 is coupled to the coupling portion 120, the controller 400 may operate the fixing unit to fix the cleaner 200.

The controller 4001 may operate the dust collection motor 191 to suck dust within the dust bin 220. The dust is separated from the dust bin by the subatmospheric pressure generated by the dust collection motor and flows through the flow path portion 180. The dust that has flowed through the flow path portion 180 is collected in the dust collector. The dust collector is separated by the user later and the dust can be discharged.

More specifically, when the controller operates the dust collection motor, the second discharge cover 2226 is rotated by the subatmospheric pressure. When the subatmospheric pressure generated by the dust collection motor is greater than the restoring force of the second elastic member 2228 or the second discharge cover 2226, the second discharge cover 2226 rotates or deforms. Accordingly, the second dust separator 2132 communicates with the flow path portion 180.

When the second dust separator 2132 and the flow path portion 180 communicate with each other, small dust collected in the second dust separator 2132 is sucked into the flow path portion 180 by subatmospheric pressure. Since an area where the second dust separator 2132 communicates with the flow path portion 180 is much smaller than an area when the dust bin 220 is fully opened, the small dust collected in the second dust separator 2132 is sucked into the flow path portion 180 by a stronger force. The smaller the size of the through-hole 2225 of the first discharge cover is, the more the flow rate increases and the more the suction force increases.

The controller 400 operates the cover opening unit 150 to open the first discharge cover 2221 of the cleaner 20M when the controller determine that the small dust collected in the second dust separator 2132 has been emptied to some extent. The first discharge cover 2221 is opened by rotating about the first hinge 2222.

The second discharge cover 2226 rotates by the elastic force of the second elastic member 2228 or its own restoring force, and seals the through-hole 2225.

When the first discharge cover 2221 is opened, the first dust separator 2131 communicates with the flow path portion 180.

When the first dust separator 2131 and the flow path portion 180 communicate with each other, large dust collected in the first dust separator 2131 is sucked into the flow path portion 180 by subatmospheric pressure. When the first discharge cover 2221 is opened, the second dust separator 2132 also communicates with the flow path portion 180, and thus, small dust remaining in the second dust separator 2132 may be sucked into the flow path portion 180.

According to the embodiment of the present disclosure, the second discharge cover 2226 and the first discharge cover 2221 are opened stepwise, so that small dust collected in the second dust separator 2132 and large dust collected in the first dust separator 2131 can be separated and discharged stepwise. While the large dust can be easily sucked in under the influence of gravity, the small dust is adsorbed on the wall surface and is difficult to suck.

Therefore, only the second dust separator 2132 is caused to communicate with the flow path portion 180 before the dust bin 220 is fully opened, and thus, the subatmospheric pressure further increases and the flow rate increases, so that the small dust adsorbed on the wall surface can be easily sucked in, and then the dust bin 220 is fully opened to suck the large dust.

Therefore, there is an effect that the inside of the dust bin 220 can be more efficiently emptied.

Although the present invention has been described above by way of the specific embodiments, this is for describing the present invention in detail. The present invention is not limited thereto and it is clear that the present invention can be modified or improved within the spirit of the present invention by those of ordinary skill in the art.

All simple modifications or changes of the present invention fall within the scope of the present invention. The specific scope of protection of the present invention will be apparent by the appended claims.

The invention claimed is:

1. A cleaner system comprising:

a cleaner comprising:

a dust bin having an open side, a first discharge cover configured to cover a first portion of the open side of the dust bin, and a second discharge cover disposed at a center of the first discharge cover and configured to cover a second portion of the open side of the dust bin; and a cleaner station configured to mount the cleaner, the cleaner station comprising a dust collection motor configured to generate a suction force for drawing dust out of the dust bin of the cleaner.

2. The cleaner system of claim 1, wherein the cleaner further comprises:

a suction portion configured to receive air and dust from an outside of the cleaner;

a first dust separator that defines a first part of an inner space of the dust bin and is in fluid communication with the suction portion and the first portion of the open side of the dust bin; and a second dust separator that defines a second part of the inner space of the dust bin and is in fluid communication with the first dust separator and the second portion of the open side of the dust bin, the second dust separator being disposed downstream of the first dust separator, wherein the first discharge cover is configured to cover the first dust separator, and wherein the second discharge cover is configured to cover the second dust separator.

3. The cleaner system of claim 2, wherein the first dust separator is disposed at an outer circumference of the second dust separator.

4. The cleaner system of claim 1, wherein the first discharge cover defines a through-hole, and wherein the second discharge cover is disposed at the through-hole of the first discharge cover.

5. The cleaner system of claim 4, wherein the first discharge cover has a circular shape.

6. The cleaner system of claim 1, wherein the first discharge cover comprises a first hinge configured to be disposed a top of the first discharge cover based on the cleaner being mounted on the cleaner station.

7. The cleaner system of claim 6, wherein the first discharge cover is configured to rotate upward about the first hinge to thereby open the dust bin, the first hinge defining a rotational axis of the first discharge cover.

8. The cleaner system of claim 6, further comprising a first elastic member disposed at the first hinge and configured to provide an elastic force to the first discharge cover in a direction away from the open side of the dust bin.

9. The cleaner system of claim 6, wherein the first discharge cover comprises a coupling lever configured to be disposed below the first discharge cover based on the cleaner being mounted on the cleaner station.

10. The cleaner system of claim 1, wherein the second discharge cover is configured to open in a direction away from the dust bin.

11. The cleaner system of claim 1, wherein the second discharge cover comprises a second hinge configured to be disposed at a top of the second discharge cover based on the cleaner being mounted on the cleaner station.

12. The cleaner system of claim 11, wherein the second discharge cover is configured to rotate upward about the second hinge to open the dust bin, the second hinge defining a rotational axis of the second discharge cover.

13. The cleaner system of claim 11, wherein the cleaner further comprises a second elastic member disposed at the second hinge and configured to provide an elastic force to the second discharge cover in a direction toward the dust bin.

14. The cleaner system of claim 1, wherein at least a portion of the second discharge cover is made of an elastic material.

15. The cleaner system of claim 1, wherein the dust bin is configured to be disposed above the dust collection motor based on the cleaner being mounted on the cleaner station.

16. The cleaner system of claim 1, wherein the first discharge cover is configured to, based on the cleaner being mounted on the cleaner station, define a plane perpendicular to a ground that supports the cleaner station.

17. The cleaner system of claim 1, wherein an area of the first portion of the open side of the dust bin is larger than an area of the second portion of the open side of the dust bin.

18. A cleaner system comprising:

a cleaner; and a cleaner station configured to mount the cleaner, wherein the cleaner comprises:

a dust bin having an open side, the open side of the dust bin being configured to, based on the cleaner being mounted on the cleaner station, defined a plane perpendicular to a ground that supports the cleaner station, a first discharge cover configured to cover a first portion of the open side of the dust bin, and a second discharge cover disposed at a center of the first discharge cover and configured to cover a second portion of the open side of the dust bin, and wherein the cleaner station comprises a dust collection motor configured to generate a suction force for drawing dust out of the dust bin of the cleaner.

19. A cleaner comprising:

a suction portion configured to receive air and dust from an outside of the cleaner;

a dust bin having an open side;

a first dust separator that is disposed within the dust bin and in fluid communication with the suction portion;

a second dust separator that is disposed downstream of the first dust separator and in fluid communication with the first dust separator;

a first discharge cover configured to cover a first portion of the open side of the dust bin, the first portion of the open side of the dust bin being in fluid communication with the first dust separator; and a second discharge cover coupled to the first discharge cover by a hinge and configured to cover a second portion of the open side of the dust bin, the second portion of the open side of the dust bin being in fluid communication with the second dust separator.

* * * * *